US010804649B2

(12) United States Patent
Beaufort et al.

(10) Patent No.: US 10,804,649 B2
(45) Date of Patent: Oct. 13, 2020

(54) NON-CONDUCTIVE MEMBER BETWEEN INCOMPATIBLE POWER TERMINALS

(71) Applicant: Hewlett-Packard Development Company, L.P., Spring, TX (US)

(72) Inventors: Richard F Beaufort, Boise, ID (US); Robin P Yergenson, Boise, ID (US); David R Connolly, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/349,500

(22) PCT Filed: Jan. 9, 2017

(86) PCT No.: PCT/US2017/012760
§ 371 (c)(1),
(2) Date: May 13, 2019

(87) PCT Pub. No.: WO2018/128635
PCT Pub. Date: Jul. 12, 2018

(65) Prior Publication Data

US 2019/0296490 A1 Sep. 26, 2019

(51) Int. Cl.

| | |
|---|---|
| ***H01R 13/44*** | (2006.01) |
| ***H01R 13/443*** | (2006.01) |
| ***H01R 13/453*** | (2006.01) |
| ***H01R 13/645*** | (2006.01) |
| ***H01R 24/70*** | (2011.01) |

(52) U.S. Cl.
CPC ..... *H01R 13/645* (2013.01); *H01R 13/44* (2013.01); *H01R 13/443* (2013.01); *H01R 13/4538* (2013.01); *H01R 24/70* (2013.01)

(58) Field of Classification Search
CPC ..... H01R 13/64; H01R 13/645; H01R 13/44; H01R 13/4538; H01R 13/443; H01R 24/00; H01R 24/66
See application file for complete search history.

(56) References Cited

U.S. PATENT DOCUMENTS

| | | | | |
|---|---|---|---|---|
| 3,120,985 | A | 2/1964 | Hubbell | |
| 4,403,824 | A | 9/1983 | Scott | |
| 7,198,523 | B2 * | 4/2007 | Adams | H01R 13/64 439/650 |
| 7,789,686 | B2 * | 9/2010 | Kim | H01R 29/00 439/218 |
| 8,611,528 | B2 * | 12/2013 | Hazani | H01R 13/719 379/413.02 |
| 8,951,074 | B2 | 2/2015 | Severac | |
| 2012/0171891 | A1 | 7/2012 | Katou et al. | |
| 2015/0147899 | A1 | 5/2015 | Cheong Wai Luen | |

FOREIGN PATENT DOCUMENTS

| | | | |
|---|---|---|---|
| CN | 203312566 | U | 11/2013 |
| DE | 102015013383 | B3 | 10/2016 |
| GB | 2424316 | A | 9/2006 |
| WO | WO-2015018770 | A1 | 2/2015 |

* cited by examiner

*Primary Examiner* — Vanessa Girardi
(74) *Attorney, Agent, or Firm* — HP Inc. Patent Department

(57) ABSTRACT

Examples disclosed herein relate to a non-conductive member including a surface defining a first hole to mate to a first pin of a terminal and a second hole to mate to a second pin of the terminal and a third pin of the terminal; and a protrusion extending from the surface.

13 Claims, 5 Drawing Sheets

NON-CONDUCTIVE MEMBER BETWEEN INCOMPATIBLE POWER TERMINALS

BACKGROUND

Electrical devices operate on power supplied by a power source. Ensuring the correct power is supplied to a device is important to avoid damaging the device. A too high current or voltage may damage an electrical device. Some devices operate exclusively on an internal power source such as a battery, solar cell, etc. Other devices operate exclusively on a main power supply. Yet other devices operate on a combination of internal power and the main power supply.

BRIEF DESCRIPTION OF THE DRAWINGS

The following detailed description references the drawings, wherein.

DETAILED DESCRIPTION

The number of devices operating under certain electrical power requirements or power ratings are ever increasing. The number of power ratings for electrical devices is as diverse as the number of electrical devices. A number of power standards have been established to standardize the main power supply provided to businesses and households. However, these standards are not universal and different standards have been adopted by different countries. Furthermore, within countries there may be more than one power rating of a main power supply because some devices may utilize dedicated main power lines with non-standard specific power ratings (e.g., household clothes dryers or stoves). As a result, many devices utilize a power adapter to convert a main power supply to the specific power rating of a device. Unfortunately, plugs and/or sockets for different power ratings can be interchangeably coupled to each other. There is a risk of damaging an electrical device by connecting it to the wrong power rating via interchangeably coupled plugs and sockets.

To address these issues, in the examples described herein, a non-conductive member is described which includes a protrusion to block or prevent the coupling of a plug and socket of incompatible power rating while allowing electrical coupling of a compatible plug and socket. The non-conductive member may be disposed between the plug and socket.

In the following discussion and in the claims, the term "couple" or "couples" is intended to include suitable indirect and/or direct connections. Thus, if a first component is described as being coupled to a second component, that coupling may, for example, be: (1) through a direct electrical or mechanical connection, (2) through an indirect electrical or mechanical connection via other devices and connections, (3) through an optical electrical connection, (4) through a wireless electrical connection, and/or (5) another suitable coupling. The term "connect" or "connects" is intended to include suitable direct connections. Similarly, the term "engage" or "engages" is intended to include a direct connection between objects. The term "approximately" as used herein to modify a value is intended to be determined based on the understanding of one of ordinary skill in the art, and can, for example, mean plus or minus up to 20% of that value. The term "power rating" refers to an upper limit of an input electrical power required (e.g., current and/or voltage) for a particular device.

Figure 1:
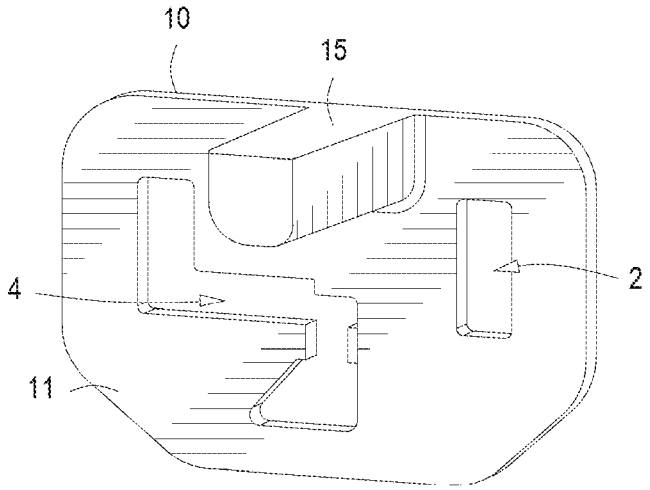
FIG. 1 is a schematic view of a non-conductive member according to an example.
Figure 2:
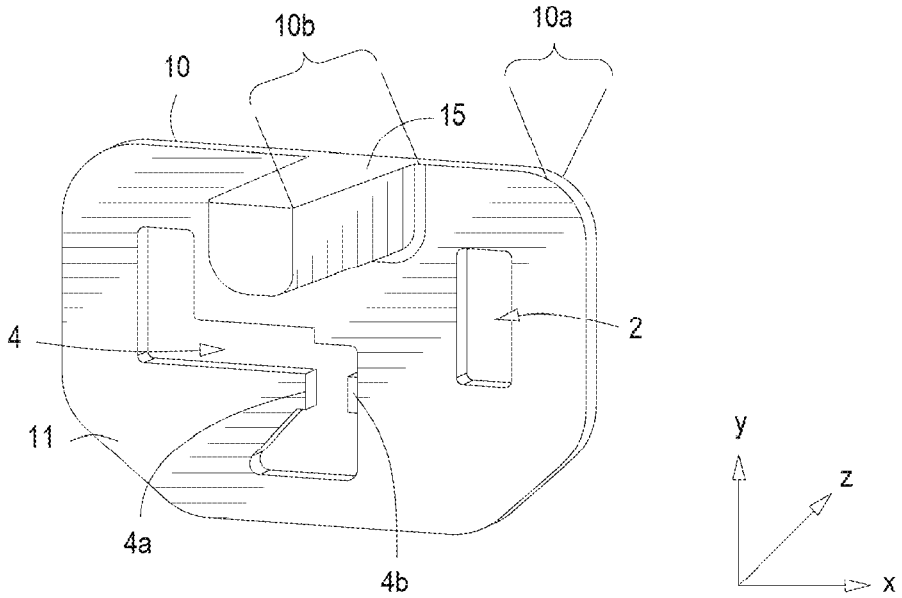
FIG. 2 is a schematic view of the non-conductive member of FIG. 1 according to an example.
Figure 3:
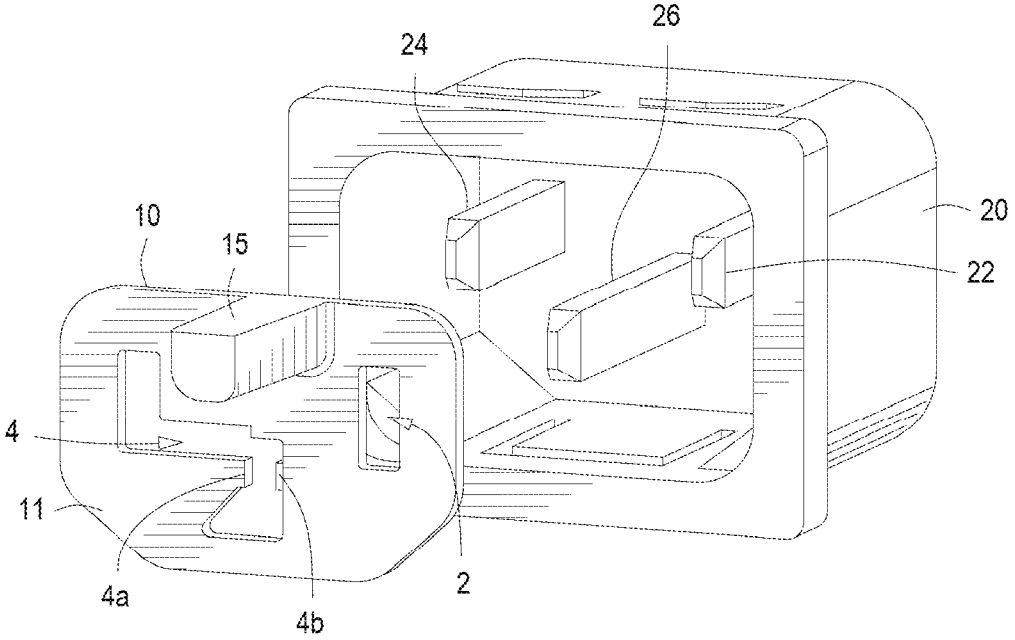
FIG. 3 is an exploded view of the non-conductive member of FIG. 1 and a terminal according to an example.
Figure 4:
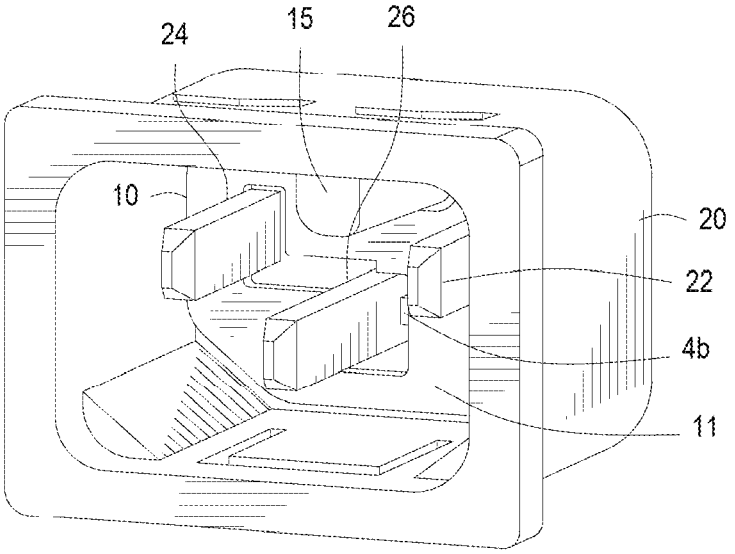
FIG. 4 is an assembled view of the non-conductive member and the terminal of FIG. 3 according to an example.

Referring now to the drawings, FIG. 1 is a schematic view of a non-conductive member 10 according to an example. FIG. 2 is a schematic view of non-conductive member 10 of FIG. 1 according to an example. FIG. 3 is an exploded view of non-conductive member 10 of FIG. 1 and a terminal 20 according to an example. FIG. 4 is an assembled view of non-conductive member 10 and terminal 20 of FIG. 3 according to an example. In examples, non-conductive member 10 includes a protrusion 15 extending from a surface 11. Surface 11 may further define hole 2 and hole 4. In examples, terminal 20 includes a pin 22, a pin 24, and a pin 26 protruding therefrom. In examples, terminal 20 may be a power plug having at least one pin to electrically couple to contacts of a socket. A socket may be a terminal including contacts that may electrically couple to a pin of a plug to provide power to the plug.

In examples, non-conductive member 10 may be composed of any non-conductive material, such as one of fiberglass, porcelain, ceramic, quartz, plastic, rubber, glass, etc. For examples, non-conductive member 10 may be an injection molded plastic. In such examples, non-conductive member 10 may be any of acrylonitrile butadiene styrene (ABS), Polypropylene (PP), polycarbonate (PC), Polycarbonate/Acrylonitrile Butadiene Styrene (PCABS), nylons, etc.

In examples, non-conductive member 10 may have a first length 10*a* along the z-axis (i.e., a width or thickness) from a rear surface of non-conductive member 10 to the surface 11. Similarly, non-conductive member 10 may have a second length 10*b* along the z-axis which includes first length 10*a* and a length of protrusion 15 extending from surface 11 along the z-axis. In examples, first length 10*a* may be selected to allow terminal 20 to electrically couple to another terminal. In such examples, terminal 20 may couple to another terminal via one or more of pin 22, pin 24, and pin 26. In examples, second length 10*b* may be selected to allow terminal 20 to electrically couple to a compatible terminal (e.g., socket) while preventing or blocking electrical coupling to a non-compatible terminal. In such examples, protrusion 15 may be dimensioned to block or prevent non-compatible terminals from electrically coupling while allowing electrical coupling of compatible terminals. Various parameters related to protrusion 15 may be selected for the particular use and design of terminal 20. For example, the dimensions, location, and orientation of protrusion 15 may be determined by the size of the terminal 20 and the particular use of the system.

In examples, non-conductive member 10 may couple to an assembly including a plug and socket via hole 2 and hole 4. In an example, hole 2 may mate with a pin 22 of terminal 20. In such an example, a cross-section of hole 2 may be substantially rectangular. However, the examples are not limited thereto, hole 2 may have any cross-sectional shape (e.g., a polygon) to mate with pin 22 or any other blade, boss, protrusion, or lug extending from a terminal. In examples, hole 2 may engage or clasp pin 22 in order to mate with pin 22. In other examples, hole 2 may at least partially encompass or surround pin 22 in order to mate with pin 22. In an example, hole 4 may mate with a pin 24 and a pin 26 of terminal 20. In such an example, a cross-section of hole 4 may be any shape (e.g., polygon) to mate with pin 24 and pin 26 or any other blade, boss, protrusion, or lug extending from a power terminal. In examples, hole 4 may engage or clasp one or both of pin 24 and pin 26 to mate therewith. In other examples, hole 4 may at least partially encompass or surround one or both of pin 24 and pin 26 to mate therewith. In yet another example, depicted in FIGS. 1-5, hole 4 may at least partially encompass or surround pin 24 and engage or clasp pin 26 to mate therewith. In such an example, hole 4 may include a wall 4*a* and a wall 4*b* to contact pin 26. In other words, wall 4*a* and wall 4*b* may clasp pin 26. In such examples, a sidewall of hole 4 may not contact pin 24 while in contact with pin 26.

Figure 5:
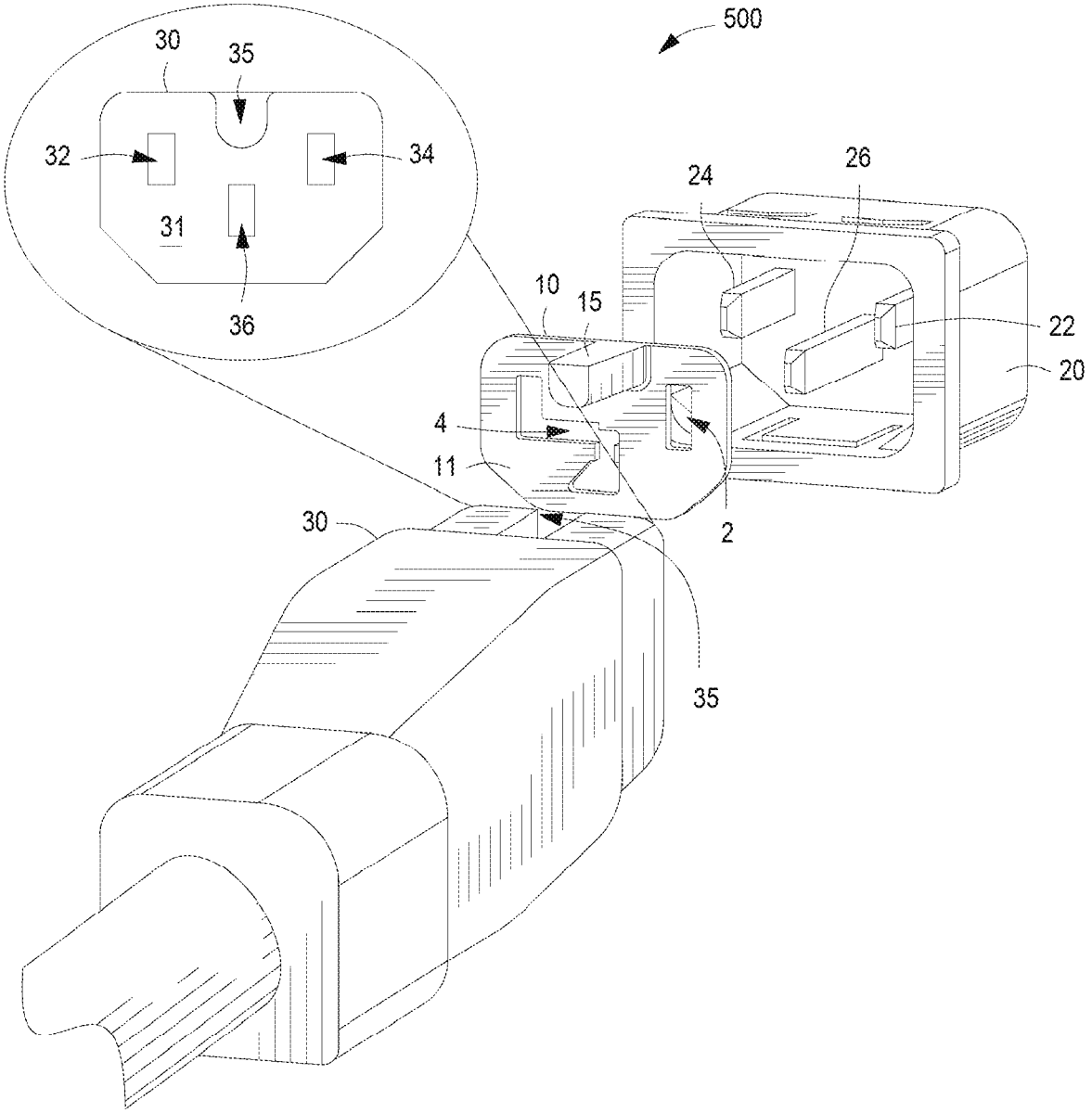
FIG. 5 is an exploded view of a keyed assembly including the non-conductive member of FIG. 1 according to an example.

FIG. 5 is an exploded view of a keyed assembly 500 including non-conductive member 10 according to an example. In examples, the term "keyed assembly" refers to an assembly of parts that may be electrically coupled together. In other words, the components of the keyed assembly may be connected to each other to electrically couple a first component and a last component of the assembly. In contrast, the term "non-keyed assembly" refers to an assembly of parts that cannot be electrically coupled together. In other words, a first component and a last component of the assembly will not be electrically coupled together if the components of the assembly are connected to each other.

In the example of FIG. 5, keyed assembly 500 includes terminal 20, non-conductive member 10, and terminal 30. In such examples, keyed assembly 500 may be assembled such that non-conductive member 10 is disposed between terminal 20 and terminal 30. In such an example, terminal 30 may be electrically coupled to terminal 20. Terminal 30 may be a socket including contacts to electrically couple to at least one pin of terminal 20. In examples, terminal 30 may include surface 31 defining hole 32, hole 34, hole 36, and hole 35. In examples, one or more of hole 32, hole 34, and hole 36 may include electrical contacts to electrically couple to pins of terminal 20. In such examples, hole 35 may not include electrical contacts to electrically couple to a blade, boss, protrusion, or lug inserted therein. In examples, hole 35 may be an aperture, opening, crevice, slot, vent, or gap to receive protrusion 15.

In the example of FIG. 5, length 10*a* of non-conductive member 10 may be selected to allow pin 22, pin 24, and pin 26 to electrically couple to terminal 30. For example, first length 10*a* may be between approximately 0.1 and 10 mm. In such examples, length 10*b* may be selected to allow hole 35 to at least partially encompass protrusion 15 without interfering with the electrical coupling between terminal 20 and terminal 30. For example, the length of protrusion 15 extending from surface 11 may be between approximately 2 mm and 5 mm. In other words, second length 10*b* may be between approximately 2.1 mm and 15 mm.

Figure 6:
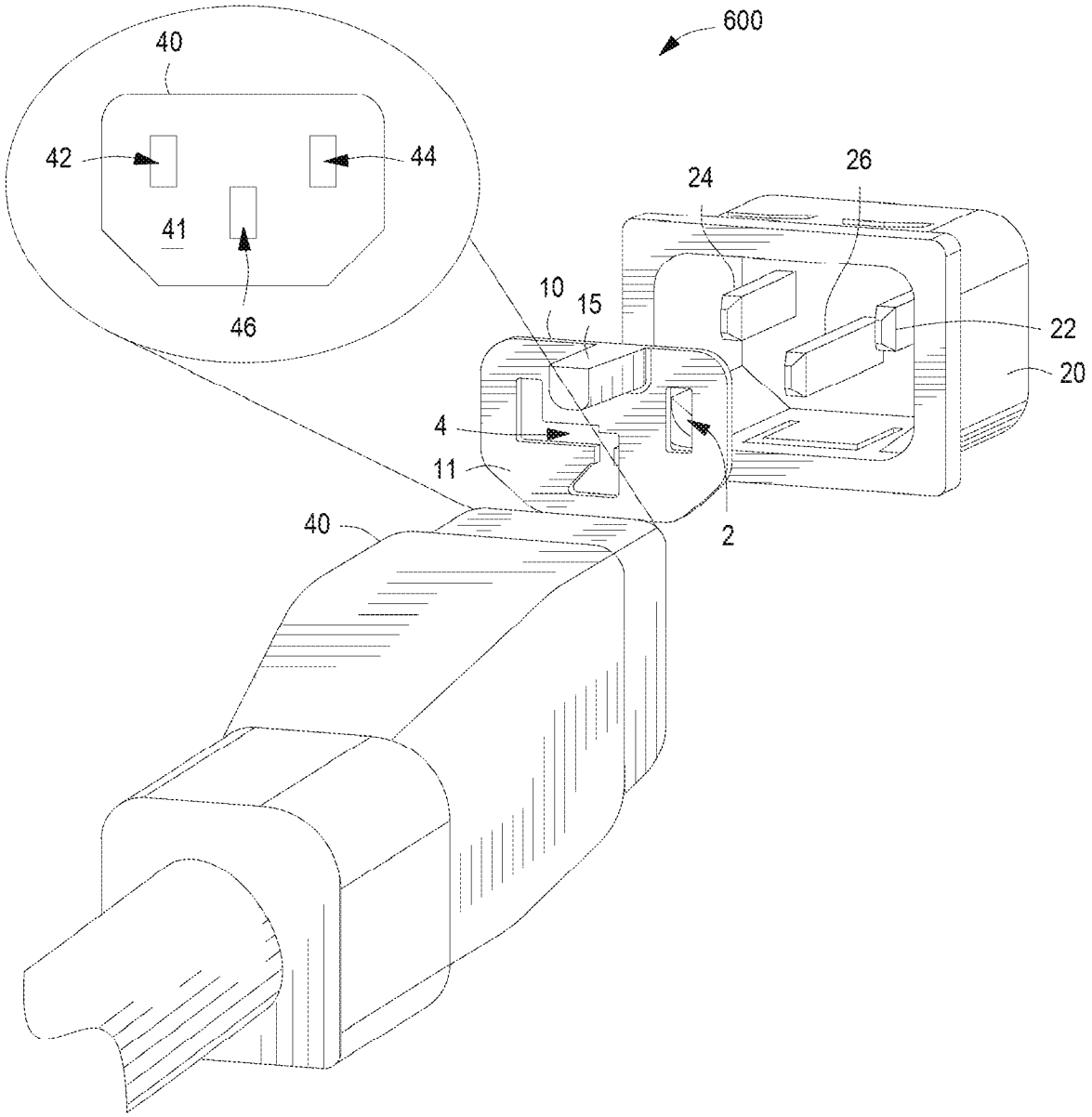
FIG. 6 is an exploded view of a non-keyed assembly including the non-conductive member of FIG. 1 according to an example.

FIG. 6 is an exploded view of a non-keyed assembly 600 including non-conductive member 10 according to an example. In the example of FIG. 6, non-keyed assembly 600 includes terminal 20, non-conductive member 10, and terminal 40. In such examples, non-keyed assembly 600 may be assembled such that non-conductive member 10 is disposed between terminal 20 and terminal 40. Terminal 40 may be a socket including contacts to electrically couple to at least one pin of terminal 20. However, in the example of FIG. 6, terminal 40 and terminal 20 may not be electrically coupled when non-conductive member 10 is disposed there between. In examples, terminal 40 may include surface 41 defining hole 42, hole 44, and hole 46. In examples, protrusion 15 may not engage an aperture, opening, crevice, slot, vent, or gap of terminal 40. Rather, in such an examples, protrusion 15 may abut surface 41 to prevent an electrical coupling between terminal 20 and terminal 40. As such, protrusion 15 may block or prevent terminal 40 from electrically coupling to terminal 20 when non-keyed assembly 600 is assembled. In other words, non-conductive member 10 may block or prevent a plug (e.g., terminal 20) from electrically coupling to an incompatible socket (e.g., terminal 40). In some examples, protrusion 15 may allow terminal 20 and terminal 40 to mechanically couple without allowing electrical coupling.

Figure 7:
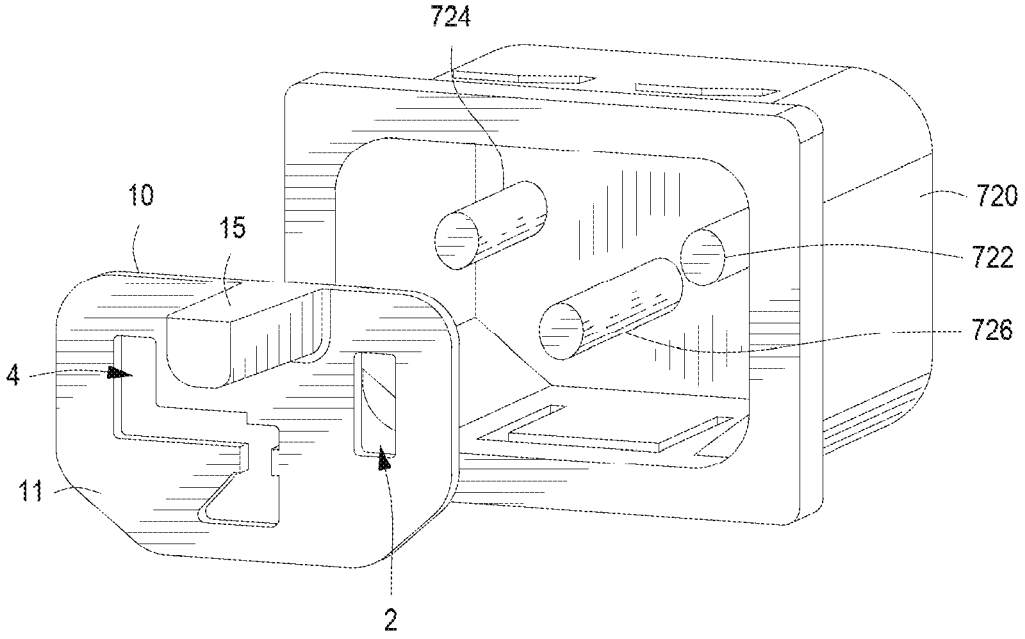
FIG. 7 is an exploded view of the non-conductive member of FIG. 1 and a terminal according to an example.
Figure 8:
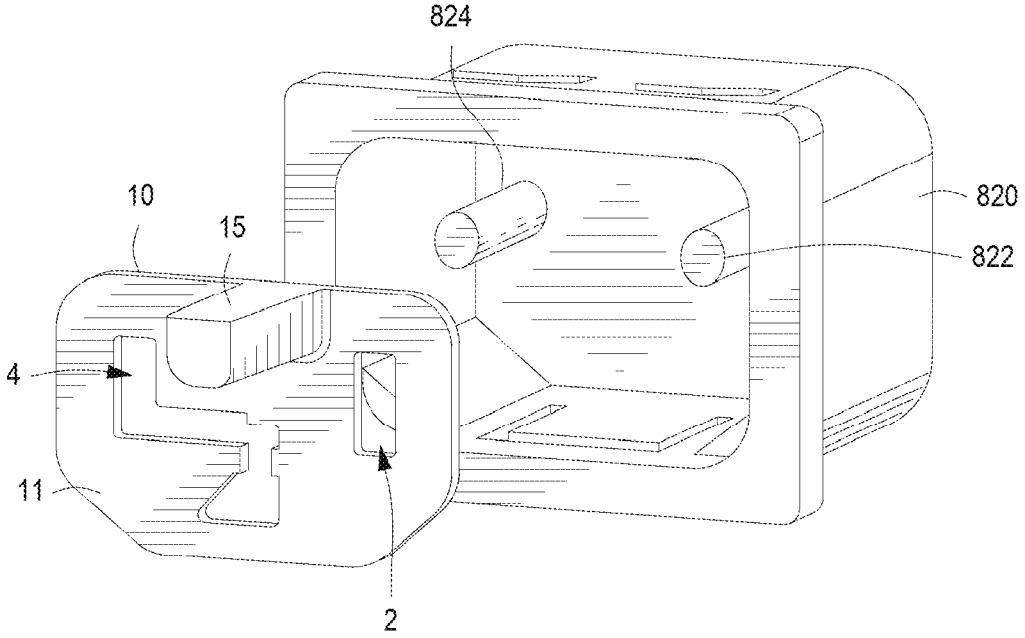
FIG. 8 is an exploded view of the non-conductive member of FIG. 1 and a terminal according to an example.

Although depicted with a rectangular cross-section, pin 22, pin 24, and pin 26 of terminal 20 are not limited thereto. Rather, terminal 20 may have pins with any cross-sectional shape. For examples, as depicted in FIGS. 7-8, terminal 20 may have one or more pins with a circular cross-section. Although depicted with three pins, terminal 20 may have any number of pins. For examples, as depicted in FIG. 8, terminal 20 may have two pins.

FIG. 7 is an exploded view of non-conductive member 10 and a terminal 720 according to an example. FIG. 8 is an exploded view of non-conductive member 10 and a terminal 820 according to an example. In the examples, terminal 720 may include a pin 722, a pin 724, and a pin 726. In the examples, terminal 820 may include a pin 822 and a pin 824. In the examples, pin 722, pin 724, pin 726, pin 822, and pin 824 may have a circular cross-section. In such examples, non-conductive member 10 may mate with terminal 720 or terminal 820 via hole 2 and hole 4 in a manner similar to that described with respect to terminal 20 in the description of FIGS. 1-6.

In examples, in operation, non-conductive member 10 may be disposed between two terminals to allow electrical coupling when the terminals have compatible power ratings while blocking non-compatible terminals from electrically coupling. In such examples, a thickness of non-conductive member 10 is selected to allow electrical coupling when protrusion 15 is at least partially encompassed by a hole, opening, aperture, etc. in a terminal. A length of protrusion 15 is selected to prevent electrical coupling of non-compatible terminals. In such examples, protrusion 15 may abut a surface of a terminal to prevent electrical coupling.

While certain implementations have been shown and described above, various changes in form and details may be made. For example, some features that have been described in relation to one implementation can be related to other implementations. In other words, features, components, and/or properties described in relation to one implementation can be useful in other implementations. Furthermore, it should be understood that the systems, assemblies, described herein can include various combinations and/or sub-combinations of the components and/or features of the different implementations described. Thus, features described with reference to one or more implementations can be combined with other implementations described herein.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A non-conductive member, comprising:

a surface defining a first hole to mate to a first pin of a first terminal and a second hole to mate to a second pin of the first terminal and a third pin of the first terminal, wherein the first hole has a rectangular cross-section; and a protrusion extending from the surface.

2. The non-conductive member of claim 1, wherein the second hole is larger than the first hole.

3. The non-conductive member of claim 1, wherein the second hole has a polygon as a cross-section.

4. The non-conductive member of claim 1, further comprising:

a first width of the non-conductive member such that when the non-conductive member is coupled to the first terminal, the first terminal may electrically couple to a second terminal.

5. The non-conductive member of claim 1, wherein the first width is between 0.1 mm and 10 mm.

6. The non-conductive member of claim 1, wherein the member is to clasp the second power pin via a sidewall of the second hole.

7. The non-conductive member of claim 1, wherein the protrusion is to block an electrical contact between the first terminal and a third terminal.

8. A non-conductive member, comprising:

a surface to engage a first power pin of a first terminal via a first hole defined therein and to couple to a second power pin of the first terminal and a third power pin of the first terminal via a second hole defined therein, wherein the first hole has a rectangular cross-section; and a boss extending from the surface to engage a hole in a second terminal, wherein the boss is to block an electrical contact between the first terminal and a third terminal.

9. The member of claim 8, wherein the second hole is larger than the first hole.

10. The member of a claim 8, wherein the non-conductive member is composed of one or more of fiberglass, porcelain, ceramic, quartz, plastic, rubber, and glass.

11. The member of claim 8, further comprising:

a first width of the non-conductive member such that when the non-conductive member is coupled to the first terminal, the first terminal may electrically couple to a second terminal.

12. The ember of claim 8, wherein the first width is between 0.1 mm and 10 mm.

13. A non-conductive element, comprising:

a non-conductive surface defining a first hole to mate with a first pin of a first terminal, and a second hole to mate with a second pin and a third pin of the first terminal, wherein the first hole has a rectangular cross-section; and a lug extending from the non-conductive surface to engage a hole in a second terminal, wherein the lug is to prevent an electrical contact between the first terminal and a second terminal;

wherein a width of the lug is between 0.1 and 10 mm and the lug extends between 2 mm-5 mm from the non-conductive surface.

* * * * *